United States Patent [19]

Theriault

[11] 4,042,238

[45] Aug. 16, 1977

[54] RACKET

[75] Inventor: Maurice N. Theriault, Renton, Wash.

[73] Assignee: Composite Structures Corporation, Kent, Wash.

[21] Appl. No.: 544,299

[22] Filed: Jan. 27, 1975

[51] Int. Cl.[2] ..... A63B 51/10

[52] U.S. Cl. ..... 273/73 C; 273/73 D; 273/73 G; 273/73 J; 428/116

[58] Field of Search ..... 273/3 R, 6, 67 R, 73 R, 273/73 C, 73 D, 73 F, 73 G, 73 H, 73 J, 73 K, 167 R, DIG. 7; 52/615; 124/23 R; 29/191.4; 280/11.13 L; 428/71, 72, 116, 118; 156/297, 299, 300

[56] References Cited

U.S. PATENT DOCUMENTS

| | | | |
|---|---|---|---|
| 2,171,223 | 8/1939 | Robinson | 273/73 H |
| 2,542,661 | 2/1951 | Godfrey | 273/73 D |
| 2,870,057 | 1/1959 | Goldstein | 428/116 X |
| 2,878,020 | 3/1959 | Robinson | 273/73 F |
| 3,015,327 | 1/1962 | Lightcap | 273/73 F X |
| 3,201,138 | 8/1965 | Brown | 280/11.13 L |
| 3,483,055 | 12/1969 | Eshbaugh | 273/73 F X |
| 3,548,484 | 12/1970 | Carlton | 273/73 D X |
| 3,635,483 | 1/1972 | Barriball | 280/11.13 L |
| 3,664,669 | 5/1972 | Latham et al. | 273/73 D |
| 3,690,658 | 9/1972 | Howe | 273/73 C |
| 3,702,189 | 11/1972 | Galich | 273/73 H |
| 3,740,301 | 6/1973 | Manning et al. | 273/73 F X |
| 3,806,928 | 4/1974 | Costanza | 156/297 X |
| 3,840,230 | 10/1974 | Schaefer et al. | 273/73 F |
| 3,879,035 | 4/1975 | Danchulis et al. | 273/73 C |
| 3,930,648 | 1/1976 | Brown | 273/73 D |

FOREIGN PATENT DOCUMENTS

| | | | |
|---|---|---|---|
| 796,769 | 1/1936 | France | 273/73 F |
| 2,210,574 | 10/1973 | Germany | 273/73 C |
| 427,206 | 4/1935 | United Kingdom | 273/73 R |
| 446,348 | 4/1936 | United Kingdom | 273/73 C |
| 498,430 | 1/1939 | United Kingdom | 273/73 D |
| 1,122,895 | 8/1968 | United Kingdom | 273/73 F |

*Primary Examiner*—Richard J. Apley
*Attorney, Agent, or Firm*—Morris A. Case

[57] ABSTRACT

A racket and method of making same structured with a wide throat spanned with a structural member and the racket having a multi-thickness honeycomb core joined together with and encased in reinforced plastic. A plastic strip with a plurality of integral grommets inserted in the head of the racket has a reduced area between grommets.

12 Claims, 16 Drawing Figures

Fig. 1
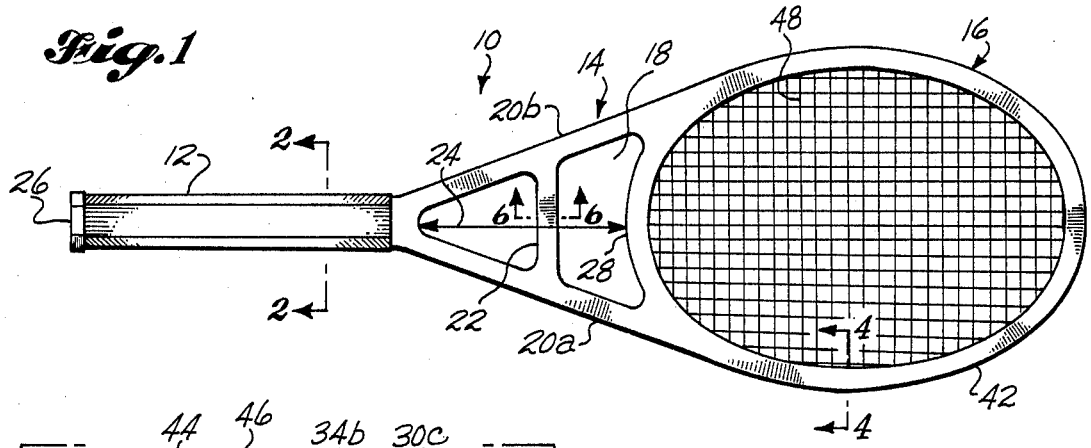
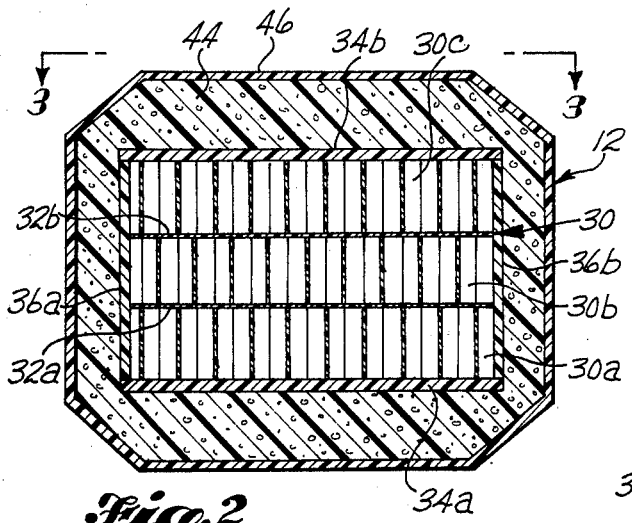
Fig. 2
Fig. 3
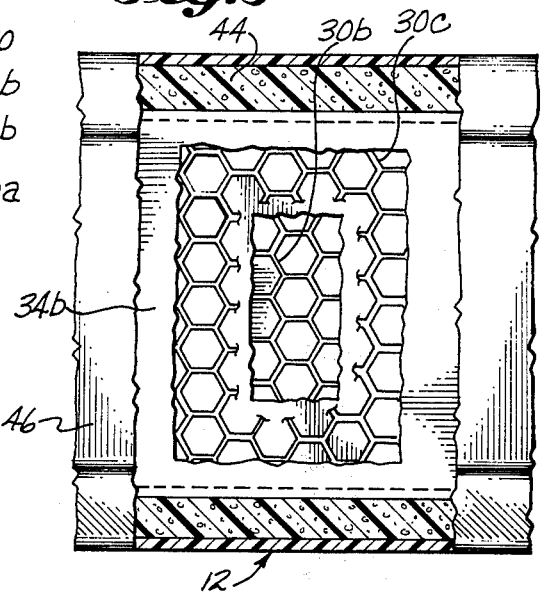
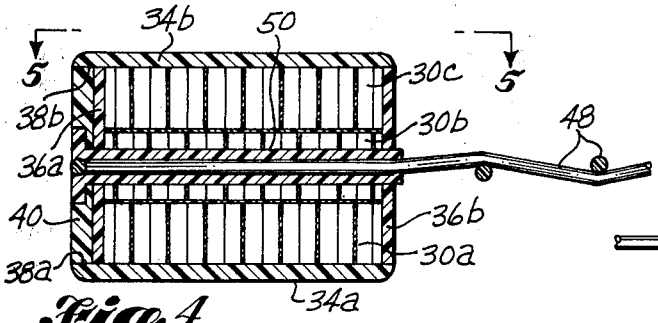
Fig. 4
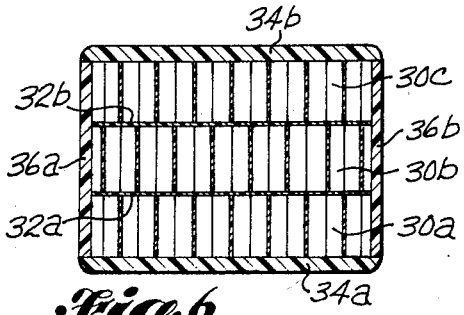
Fig. 6
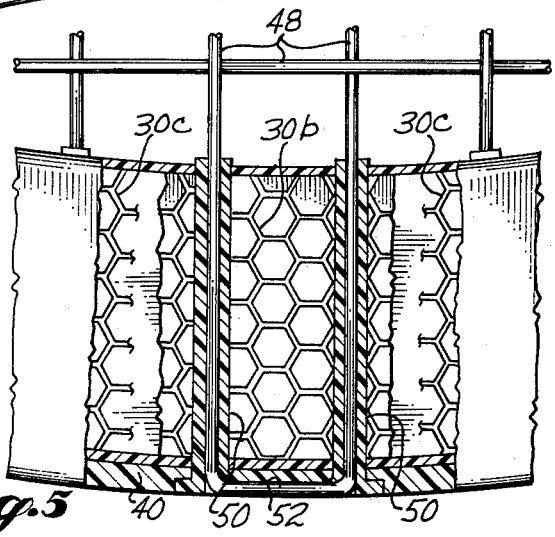
Fig. 5

Fig. 7
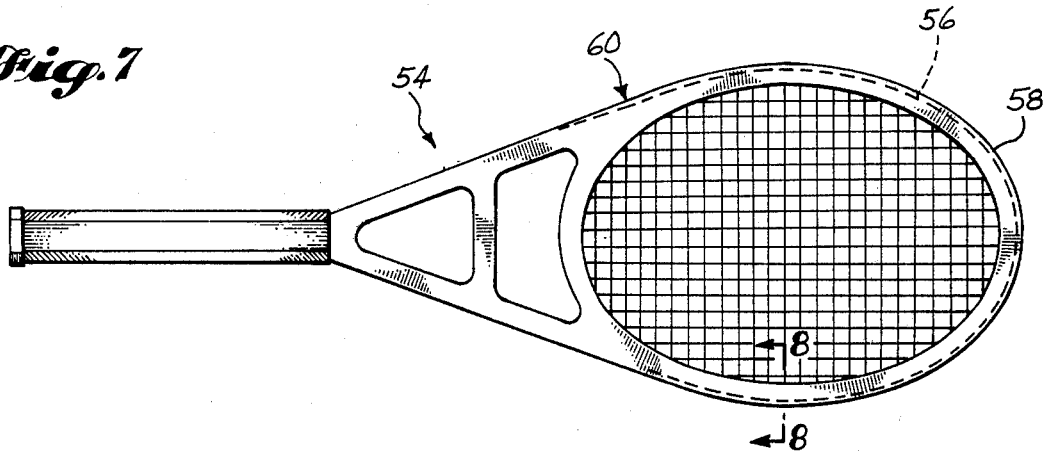
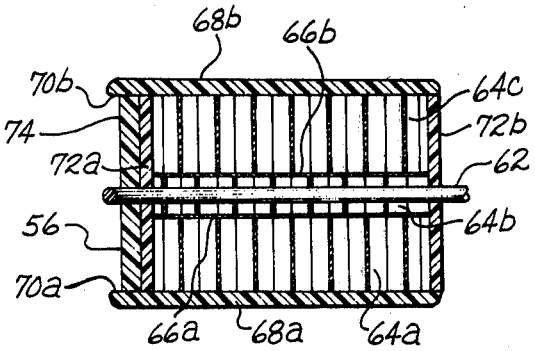
Fig. 8
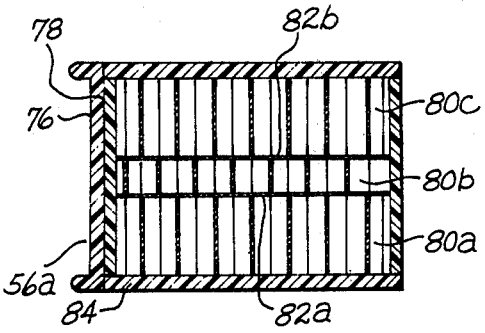
Fig. 9

Fig. 10
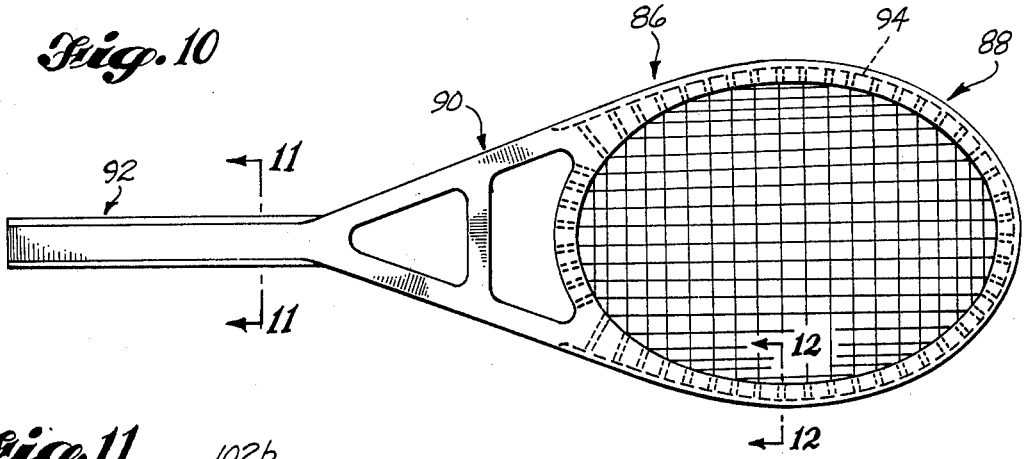
Fig. 11
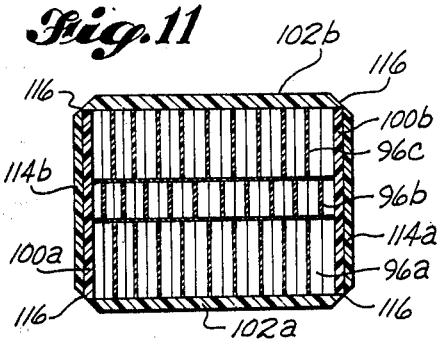
Fig. 12
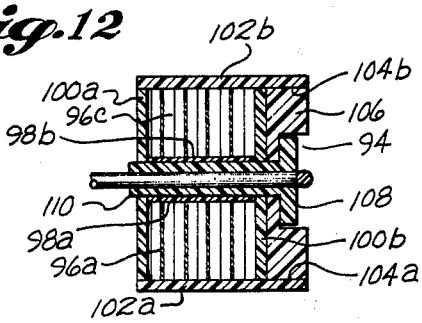
Fig. 14
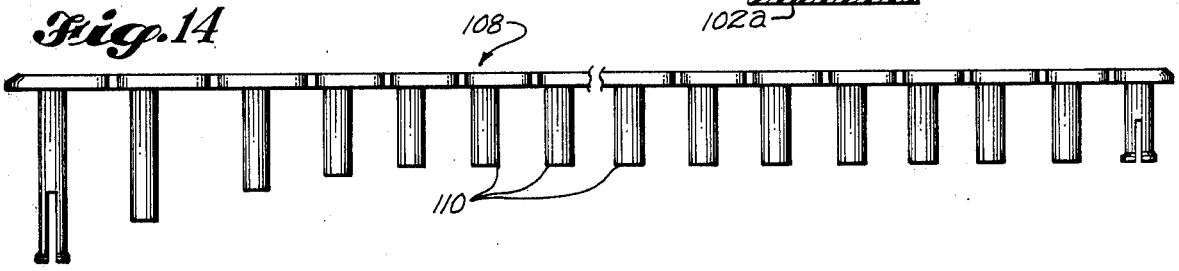
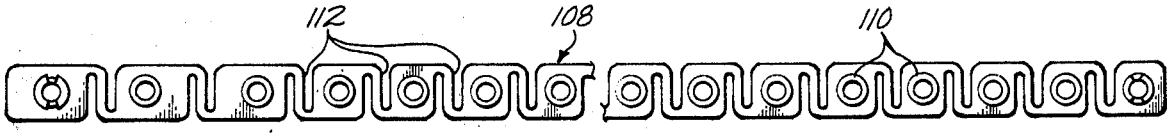
Fig. 13
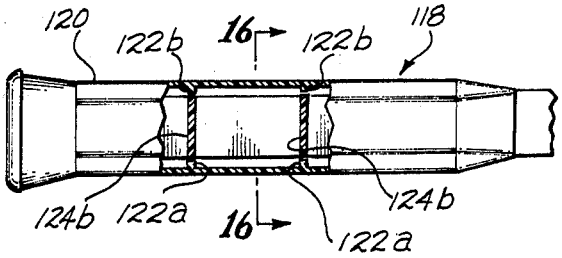
Fig. 15
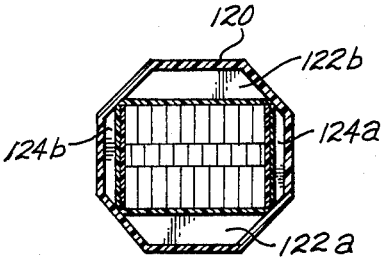
Fig. 16

RACKET

BACKGROUND OF THE INVENTION

Rackets such as a tennis racket require characteristics of longitudinal bending rigidity and torsional rigidity to stand up under loads imparted when in use. In addition, the head of the racket must not give or warp due to the tension imparted by stringing. Historically wood has been used for racket structure, however, more recently metals and combinations of metal and reinforced plastics are being used. U.S. Pat. No. 3,702,701 utilizes an extruded metal frame with a molded plastic throat. U.S. Pat. No. 3,690,658 utilizes shaped metal face sheets covering layers of elastomeric material and a syntactic foam core.

It was discovered a racket utilizing honeycomb core material covered with a resin impregnated reinforcement gives excellent racket characteristics.

SUMMARY OF THE INVENTION

A tennis racket with a wide throat formed by arms extending from the handle to a head or essentially oval shaped frame. A reinforcing member extends between the arms across the throat. All of the structure areas of the racket have an integral honeycomb core with open cells of the core extending between the faces of the racket, and a reinforced plastic edge closure cover. Preferably, the honeycomb core is made up with two or more thicknesses or layers of honeycomb with a bonding layer of a plastic between the layers of honeycomb. All bonding layers or encasement of plastic are firmly bond to the honeycomb, but do not fill the cells. A thermosetting resin advanced to the B-stage may be used to assure a good bond without flowing into and filling the cells.

A strip of plastic with a plurality of grommets extending normal thereto has reduced areas between grommets. The grommets extend through the head of the racket and the reduced area in the strip prevents the build up of stresses.

An object of this invention is to provide a lightweight racket with outstanding torsional rigidity, longitudinal bending characteristics and dimensional stability.

Another object of this invention is to provide a racket with an integral honeycomb core.

It is yet another object to provide a strip with grommets for use in a racket without building up stresses in the strip.

DESCRIPTION OF THE DRAWINGS

FIG. 1 shows a plan view of the racket of this invention.

FIG. 2 is a cross sectional view of the handle area of the racket taken along lines 2—2 of FIG. 1.

FIG. 3 is a fragmented plan view of the handle partially cut away.

FIG. 4 is a cross sectional view of the head area of the racket taken along lines 4—4 of FIG. 1.

FIG. 5 is a fragmented plan view of the head partially cut away as viewed from 5—5 of FIG. 4.

FIG. 6 shows a section of a throat reinforcing member taken along lines 6—6 of FIG. 1.

FIG. 7 shows a plan view of a different embodiment of the racket of FIG. 1.

FIG. 8 is a sectional view taken along lines 8—8 of FIG. 7.

FIG. 9 is a sectional view as in FIG. 8 but of another embodiment.

FIG. 10 shows a plan view of yet another embodiment of the racket of FIG. 1 without showing the handle cover.

FIG. 11 is a sectional view taken along lines 11—11 of FIG. 10.

FIG. 12 shows a sectional view taken along lines 12—12 of FIG. 10.

FIG. 13 shows a plan view of a plastic strip with integral grommets prior to placing the strip in the racket of FIG. 10.

FIG. 14 shows a side elevational view of the strip with grommets of FIG. 13.

FIG. 15 shows a side elevational view of a cover for the handle area of FIG. 10.

FIG. 16 is a sectional view taken along line 16—16 of FIG. 15.

DETAILED DESCRIPTION

Racket 10, has handle 12, throat section 14 and head or oval frame 16. The throat 18 is defined by a pair of arms **20*a* and 20*b* which extend from the handle to opposite sides of the head. A reinforcing member 22 extends across the throat from arm to arm. The spacing of the arms provides a wide throat and the stabilizing cross member combines with the arms to yield extreme torsional resistance to off-center hits and provide accuracy in hitting an object where the racket is aimed. The arms preferably extend essentially straight to merge on a tangent with the outside periphery of the oval frame and the depth 24 of the throat preferably extends at least a third of the distance from the end of the handle 26 to the closest part 28** of the oval frame.

The entire structure of the racket 10 has an integral core 30 of honeycomb material, preferably of a metal such as aluminum. This may be a single thickness of honeycomb or may be in two or more layers of honeycomb with three layers preferred as shown at **30*a*, 30*b*, and 30*c* in FIGS. 2 through 6. The layers of honeycomb are bonded together with a layer of an adhesive, preferably a structurally reinforced resin or plastic at 32*a* and 32*b*, and the core is entirely encased in reinforced plastics made up of face sheets 34*a* and 34*b* and side covering sheets 36*a* and 36*b*. The encasing material is integral throughout the racket. In FIG. 4 the face sheets extend past side covering sheet 36*a* at 38*a* and 38*b*. A plastic material 40 preferably a high wear resistant plastic material such as polyethylene, polyurethane, or acrylo nitrile butadiene styrene is integrally bonded into the recess formed around the exposed outer periphery 42 of the head which essentially extends from arm 20*a* to 20*b*. In the handle, see FIG. 2, the encased honeycomb core is covered first with a foamed plastic 44 which in turn is bonded to a cover material 46 to form the grip for the handle. The outer dimensions may be varied to fit the requirements for various sized persons and bonded to the encased honeycomb core. The head 16 has netting 48 stretched across to form the contact surface for a ball being hit. This netting or strings may be of stretched gut, nylon, etc. In FIGS. 4 and 5 grommets 50 protect the strings when passing through the sides of the racket and the strings are recessed at 52** to prevent damage from abrasion.

In FIGS. 7 through 9 is shown a different embodiment of the invention. The racket 54 varies by having a recess 56 which extends around the outer periphery 58 of the head 60 of the racket in the exposed part of the head. This recess protects the strings 62 from abrasion. Grommets may be used but are not shown in this embodiment. In these figures a preferred embodiment is shown with the honeycomb core made up of three layers 64*a*, 64*b* and 64*c* wherein the middle layer 64*b* is narrower than the two outside layers. The honeycomb layers are bonded with reinforced plastic layers 66*a* and 66*b*. Face sheets 68*a* and 68*b* extend at 70*a* and 70*b* to form the recess 56 around the outer periphery of the head. Sides 72*a* and 72*b* in conjunction with the face sheets encase the honeycomb core. An additional layer of cover material 74 is bonded into but does not fill the recess. FIG. 9 shows yet another preferred embodiment with a recess 56*a* formed with a channel or U-shaped member 76 bonded around the outside of the exposed part of the head at 78. This U-shaped member is preferably of a resilient material such as polyurethane, but it is not intended to be limited to that material. The honeycomb core in layers 80*a*, 80*b*, and 80*c* is bonded to layers 82*a* and 82*b*, and also bonded to and encased in reinforced plastic 84. The bonding layers and the covering layers in all the figures are shown as a single thickness, however, this finished single layer may be made up of several layers of reinforcement such as but not limited to fiber glass with unidirectional, bi-directional or random layers of fiber integrally bonded with a resin such as but not limited to a epoxy resin.

FIGS. 10 through 16 show yet another embodiment of this invention. Racket 86 with head 88, throat area 90 and handle area 92 shows the outside periphery of the head to be recessed at 94 around the exposed outer periphery. The racket has an integral honeycomb core in three layers 96*a*, 96*b* and 96*c* with the middle layer 96*b* preferably thinner than the other two layers. The honeycomb may be conventional with cell openings as shown here at 90° to the face or may extend with openings at 45° to each other, however, with either type the cell openings in the honeycomb extend toward the faces of the racket. The layers of honeycomb are bonded together with structurally reinforced resin at 98*a* and 98*b*. These layers bond the honeycomb together without filling the cells of the honeycomb. Side enclosing layers 100*a* and 100*b* and face enclosing layers 102*a* and 102*b* all of reinforced plastic combine to completely encase the core. In the exposed part of the head area, as best shown in FIGS. 10 and 12 the face sheets 102*a* and 102*b* extend outward at 104*a* and 104*b*, respectively, to form a side reinforcement for a filler 106 of a thermoplastic resin such as but not limited to acrylo nitrile butadiene styrene or polyethylene. The filler does not completely fill the space, but instead leaves the recess 94. A plastic strip 108 with a plurality of integral grommets 110 is placed in the recess. The grommets extend inwardly and normal to the outer periphery of the racket head. The plastic strip has an S-shaped area 112 between each grommet to provide a reduced area to allow bending of the strip while inserting the grommets without setting up stresses. The S-shape made up with a thin transverse member joined at opposite ends to alternate grommet sections provides complete flexibility between grommets.

The handle area 92 of the racket 86 is shown in FIG. 11 with the honeycomb encased core having additional side reinforcing members 114*a* and 114*b*. All four corners 116 of the encased core are preferably bevelled at 45° as shown. In this embodiment the handle cover 118 is a sectionalized or an integral cover that is slipped over the handle end of the racket and bonded thereto. The cover comprises outside layer 120 with integral inwardly extending ribs 122*a* and 122*b*, and 124*a* and 124*b*.

The honeycomb being arranged with the longitudinal axis of the cells extending toward the faces of the racket provides longitudinal bending resistance while at the same time imparting a dampening effect to prevent shock with attendant arm fatigue in a person using the racket. The layers of resin between thicknesses of honeycomb assist in the dampening, by breaking up the honeycomb cell walls into smaller shear panels and impart side compression capability to the core to resist forces set up in the head due to tension in the strings.

I claim :

1. A racket with a handle, a throat and an open oval frame having netting therein, the racket comprising: a handle; an oval frame section connecting the handle and the oval frame formed with a pair of arms extending from the handle to merge into opposite sides of the oval frame, said throat having a depth extending at least a third of the distance from the end of the handle to the closest part of the oval frame; a structural section extending across the throat between the two arms; a core integral to all structural members, said core of a metallic honeycomb material with cell openings in the honeycomb extending toward each face of the racket; a structurally reinforced resin encasing the honeycomb core; the encasing resin around the oval frame having a recess to form a U-shaped outer perimeter extending from arm to arm; at least one plastic strip located in the recess and having a plurality of integral grommets extending through the oval frame to an inside periphery of the frame; and an S-shaped area between each grommet having a thin transverse member joined at opposite ends to alternate grommet sections to form a reduced area in the strip between grommets to permit individualized direction of the grommets without setting up stresses.

2. A racket as in claim 1 wherein the structurally reinforced resin encasing the core extends outward around the outside perimeter of the oval frame to form the U-shaped outer perimeter.

3. A racket with a handle, a throat and an open oval frame having netting stretched therein, the racket comprising: a handle; an oval frame; a throat section connecting the handle and the oval frame formed with a pair of arms extending from the handle to merge into opposite sides of the oval frame, said throat having a depth extending at least a third of the distance from the end of the handle to the closest part of the oval frame; a structural section extending across the throat between the two arms; a core integral to all structural members, said core of a metallic honeycomb material with cell openings in the honeycomb extending toward each face of the racket; a structurally reinforced resin encasing the honeycomb core; and the honeycomb core comprises at least two layers of honeycomb with a layer of structurally reinforced resin therebetween.

4. A racket as in claim 3 wherein the honeycomb core comprises three layers of honeycomb with a layer of structurally reinforced resin therebetween and the two outermost layers are thicker than the middle layer.

5. A tennis racket comprising: an ellipsoidal frame having netting stretched therein; a handle; a pair of arms extending from the handle to join on opposite sides of the ellipsoidal frame to form a throat, a structural section extending across the throat between the two arms; an integral metallic three layer honeycomb core throughout the racket structure wherein the layers of honeycomb are bonded together with layers of reinforced plastic and the center layer of honeycomb is thinner than the two outside layers; and an integral cover around the core of reinforced plastic having a recess around the exposed part of the outer perimeter of the ellipsoidal frame.

6. A tennis racket as in claim 5 wherein throat depth extends at least one third of the distance from the ellipsoidal frame to handle end.

7. A tennis racket as in claim 5 wherein the arms extend on essentially straight lines to be tangent with outer periphery of the frame.

8. A tennis racket as in claim 5 further comprising: plastic strips located around the ellipsoidal frame, each strip having a plurality of integral grommets extending normal to the outer periphery through the frame, and the plastic strip having a thin transverse member joined at opposite ends to alternate grommet sections to provide flexibility between grommets.

9. In an improved racket having an oval head, a handle and a throat between the handle and the oval head wherein the improvement comprises: a recess forming a U-shape to extend around the exposed part of the outer periphery, a plurality of grommets to extend normal to the outer periphery and through the oval head, said grommets integral to at least one plastic strip seated in the recess, and the plastic strip has an S-shaped area between each grommet of a thin transverse member joined at opposite ends to alternate grommet sections.

10. An improved racket as in claim 9 wherein the improvement further comprises: a metallic three layer honeycomb core throughout the racket structure wherein the layers of honeycomb are bonded together with layers of reinforced plastic and the center layer of honeycomb is thinner than the two outside layers, and an integral cover of reinforced plastic around the core.

11. An improved racket as in claim 10 wherein the improvement further comprises an integral structure member extending across the throat.

12. A racket with a handle, a throat and an oval frame having netting stretched therein, the racket comprising: a handle; an oval frame; a throat section connecting the handle and the oval frame formed with a pair of arms extending from the handle to merge with opposite sides of the oval frame, said throat section extending at least a third of the distance from the end of the handle to the closest part of the oval frame; a structural section extending across the throat between the two arms; a metallic honeycomb core throughout the structure of the racket having at least two thicknesses joined together with a structural reinforced plastic and open cells of the honeycomb extending toward each face of the racket; a structurally reinforced plastic encasing the core and having a recess to form a U-shaped outer perimeter around the frame extending from arm to arm; plastic strips located around the frame having a plurality of grommets extending through the oval frame and normal to the outer periphery of frame, said plastic strips having a thin transverse member joined at opposite ends to alternate grommet sections to provide flexibility between grommets.

* * * * *